US011629931B2

(12) United States Patent
Hincapie et al.

(10) Patent No.: US 11,629,931 B2
(45) Date of Patent: Apr. 18, 2023

(54) FIREARM MOUNTED ILLUMINATION AND PROJECTION SYSTEM WITH REMOTE POWER SUPPLY

(71) Applicants: Daniel Hincapie, Gainesville, GA (US); Peter Dorn Lindblom, Jr., Mooresville, NC (US)

(72) Inventors: Daniel Hincapie, Gainesville, GA (US); Peter Dorn Lindblom, Jr., Mooresville, NC (US)

( * ) Notice: Subject to any disclaimer, the term of this patent is extended or adjusted under 35 U.S.C. 154(b) by 0 days.

(21) Appl. No.: 17/405,022

(22) Filed: Aug. 17, 2021

(65) Prior Publication Data

US 2022/0057171 A1 Feb. 24, 2022

Related U.S. Application Data

(60) Provisional application No. 63/067,831, filed on Aug. 19, 2020.

(51) Int. Cl.
*F41G 1/35* (2006.01)

(52) U.S. Cl.
CPC ..... *F41G 1/35* (2013.01)

(58) Field of Classification Search
CPC ..... F41G 1/35
See application file for complete search history.

(56) References Cited

U.S. PATENT DOCUMENTS

2008/0134562 A1* 6/2008 Teetzel ..... F41G 1/35 42/114
2019/0049221 A1* 2/2019 Zimmer ..... F41G 11/003

* cited by examiner

*Primary Examiner* — Thomas M Sember

(57) ABSTRACT

This invention herein described is a firearm mountable, illumination and projection system for projecting, detecting and/or receiving electromagnetic radiation (waves) from across the electromagnetic spectrum by utilizing a variety of technologies such as LED's, Infrared Illuminators, Laser Emitters, and FLIR sensors (examples not limitations). This invention, herein described, is unique in that the embodiment(s) for Illumination and Projection are separate, unique, and isolated (distally) from the embodiment providing the necessary power (Current, Voltage, Electromotive Force) for the illumination and/or projection of electromagnetic radiation.

10 Claims, 6 Drawing Sheets

ILLUMINATION AND PROJECTION UNIT ( "IPU" )

SECTION VIEW of ILLUMINATION AND PROJECTION UNIT ( "IPU" )

ITEM NUMBERS CORRESPOND TO FIG 2

POWER and CONTROL UNIT ("PCU" )

FIREARM MOUNTED ILLUMINATION AND PROJECTION SYSTEM WITH REMOTE POWER SUPPLY

CROSS REFERENCE TO RELATED APPLICATIONS

The present application claims priority benefit to U.S. Provisional Application No. 63/067,831 filed on Aug. 19, 2020

STATEMENT REGARDING FEDERALLY SPONSORED RESEARCH OR DEVELOPMENT

The invention was not created in conjunction with any federally sponsored program for research or development

REFERENCE TO A SEQUENCING LIST

Not applicable

BACKGROUND OF THE INVENTION

Field of Invention

This invention is related to firearm accessories such as mountable flashlights, "tac" lights, infrared illuminators, and laser emitters, and detectors, and other aiming devices that are used with and mounted to firearms.

Description of Prior Art

A survey of prior art in this field shows that all firearm mountable flashlights (tac lights) and other devices for lighting, illumination, and projection of electromagnetic radiation (waves) have the power supply (batteries for example) contained within, or directly attached to, the same embodiment (housing) as the illumination and projection components (components such as an LED, reflector, lens). An example of which is Teetzel, U.S. Pat. No. 7,866,083, which shows a flashlight apparatus which has a modular power source. While modular, the power source must be attached directly to the other parts of the system and cannot be distally moved away from the other components. All of the modular components are attached together as a unit and mounted at the forward (muzzle end) of the firearm. Another example is Teetzel et al, U.S. Pat. No. 10,969,292, which does have a separate battery box (module) however this battery must be attached directly to the rail that it is meant to power. While similar, in the sense that the battery is in a separate housing, it does not have the freedom of movement as the Invention being put forth in this application. The principal function of the battery module of Teetzel et al, U.S. Pat. No. 10,969,292 is to give power to the powered rail, not to redistribute the weight to any location that the inventor or operator of the firearm desires. For example, the battery module of Teetzel et al, would not be easily moved to the butt stock of the firearm. With these examples, all the components including the power source which are necessary for these devices (flashlights, "tac" lights) to operate are located within the same embodiment (housing) and are mounted as a single unit toward the muzzle end of the firearm. This causes the muzzle end to be heavier than necessary which can negatively affect the ability of the operator of the firearm to maintain aim, and quickly return the aim of the firearm on to the intended target after each discharge of the firearm. In addition, current art of "tac" lights, firearm mounted flashlights, PEQ boxes, and other like functioning devices having the power/energy supply within the same embodiment, by necessity, creates a much larger device than the Invention described in this application would otherwise. The invention put forth in this application allows for smaller, more compact, lighter embodiments that house the principal components of illumination and projection, taking up less space at the muzzle end and creating a more agile firearm.

SUMMARY OF THE INVENTION

The purpose of this invention is to improve the performance of firearms which use accessories such as mounted flashlights (tac lights) (example not limitation) and give the operator of the firearm advantages over current art by (1) redistributing the weight of the heavier components to a more advantageous location, and (2) offering the smallest embodiment possible to contain the necessary components for illumination and/or projection, and (3) utilizing the least amount of space at the muzzle end of the firearm. This invention accomplishes this by separating the components of Illumination and Projection (LED, lens, reflector) from the heavier components needed for control and power/energy (LED drivers, batteries, logic and control circuitry) (mentioned as examples but not limitations) into separate embodiments to allow the heavier components, such as the battery(s), to be moved to a more ideal location away from the muzzle end of the firearm distally toward the opposite end of the firearm closer to the operator and the center of gravity of the firearm. In doing so, the firearm is made more agile with a lighter weight muzzle. The embodiment containing the power/energy source can be designed to be located anywhere on the firearm that is suitable to the operator, and then be connected to the embodiment containing the illumination and projection components by means of a wiring harness. In addition, this invention allows for greater flexibility in the capacity and capabilities of the power/energy supply. Because the weight of the power supply can be moved away from the muzzle, there is more space available and a larger housing can be utilized, adding more batteries which can be used to create higher voltage and/or increase the amp/hour capacity of the stored power/energy supply. Furthermore, given a larger footprint, the power and control unit (embodiment) provides more space for advanced control circuitry and sensors which creates more options for the inventor/designer to offer desirable options for the operator of the firearm. This invention takes advantage of a lighter weight muzzle, and the illumination and projection unit (embodiment) can be made as small as possible saving valuable space at the muzzle end of the firearm. At the same time, this invention takes advantage of the flexibility of a separate embodiment for the power/energy supply. The advantages are that there is more space for additional batteries (or alternate sources of power, such as fuel cell, or photovoltaic cells) more space for additional control circuits, allowing for future expansion and options for control and logic.

DETAILED DESCRIPTION OF THE INVENTION

Figure 1:
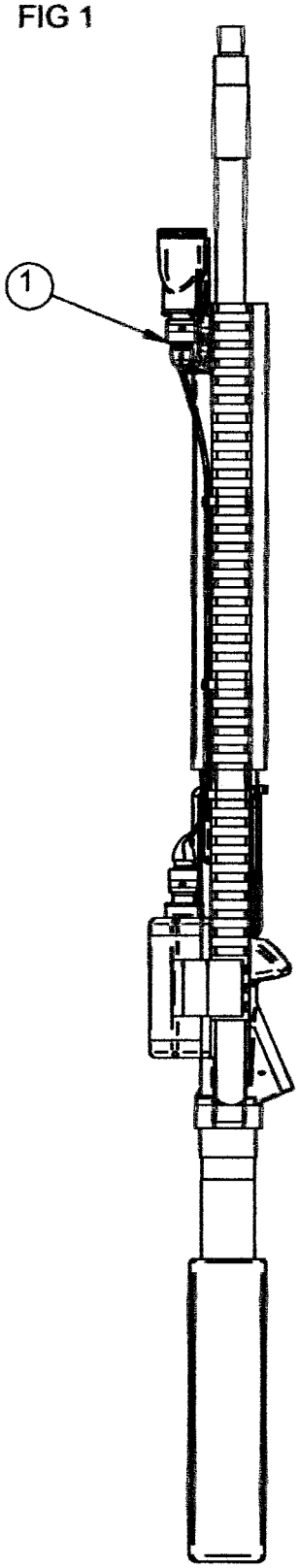
FIG. 1, and FIG. 1*a*; A top and side view of invention mounted to firearm FIG. 2; A top view of invention (as a unit) separated from firearm for clarity FIG. 3; An ISO, exploded view of components in the Illumination and Projection Unit ("IPU")
Figure 1A:
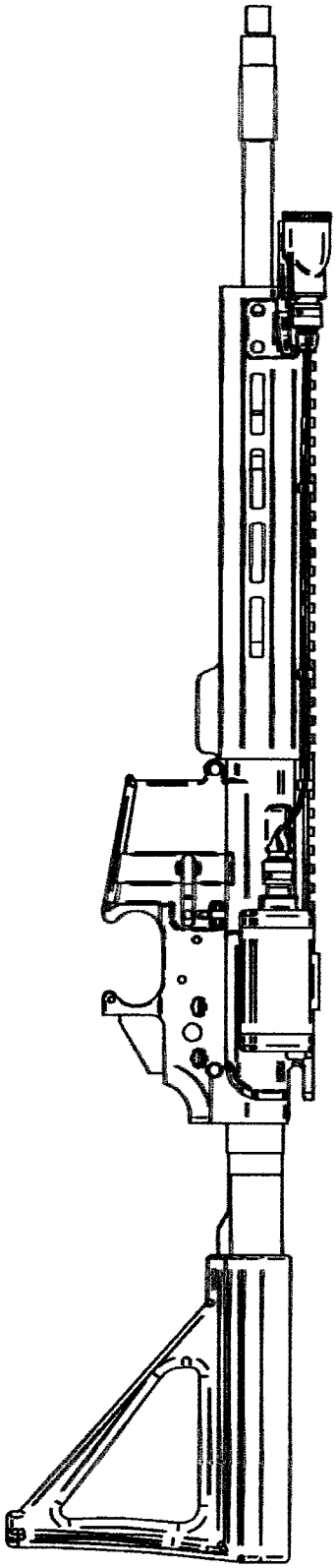
Figure 2:
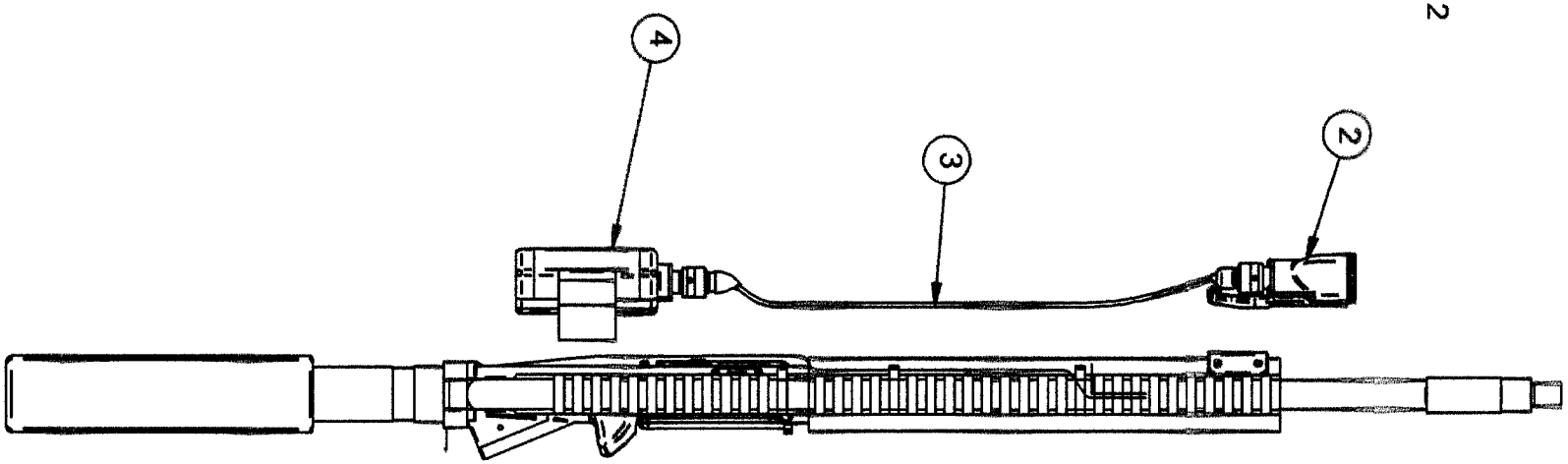
Figure 3:
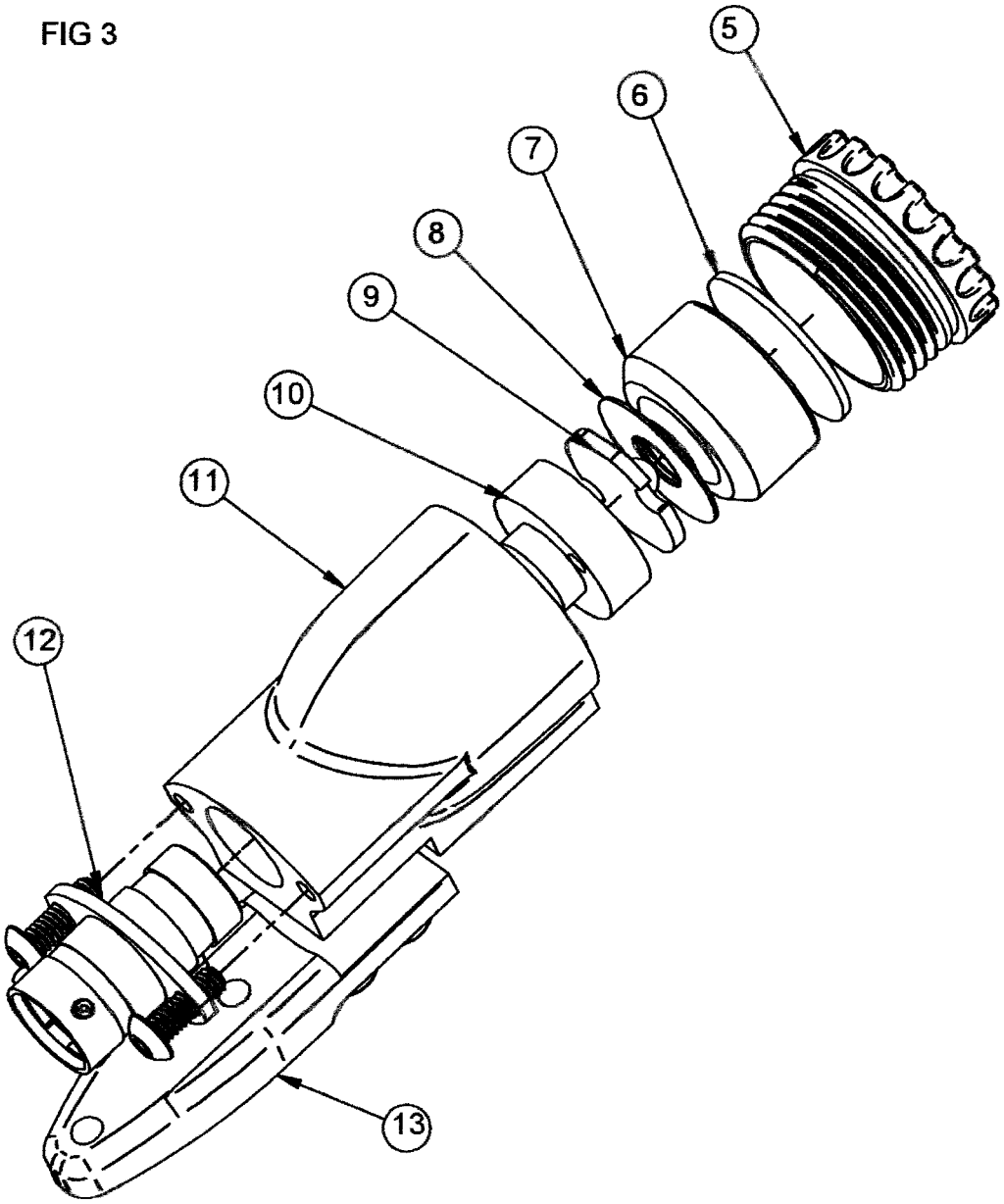
Figure 4:
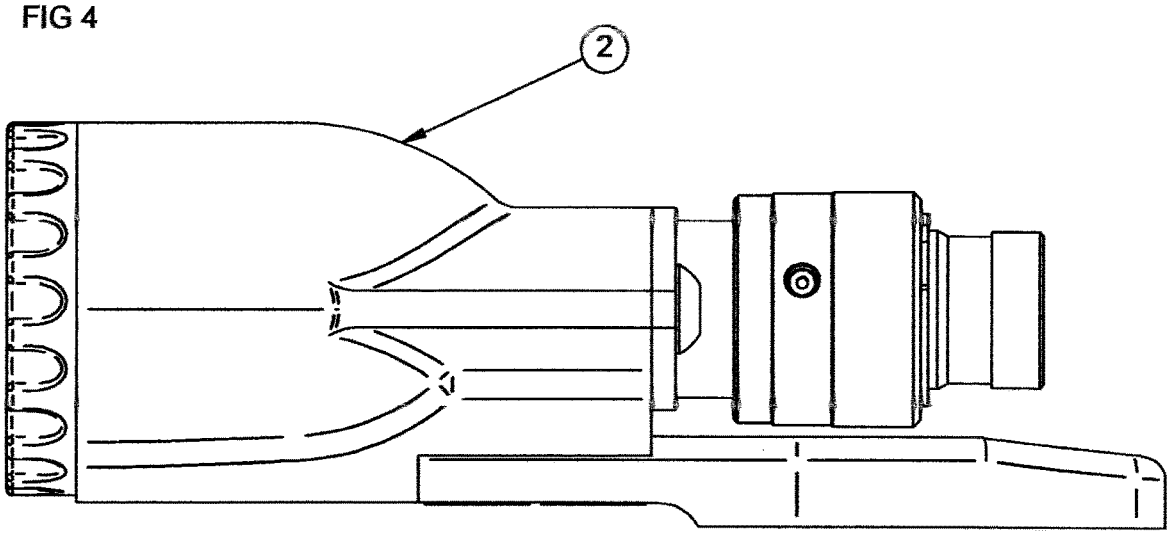
FIG. 4, and FIG. 4*a*: A side view, and side section view of the IPU
Figure 4A:
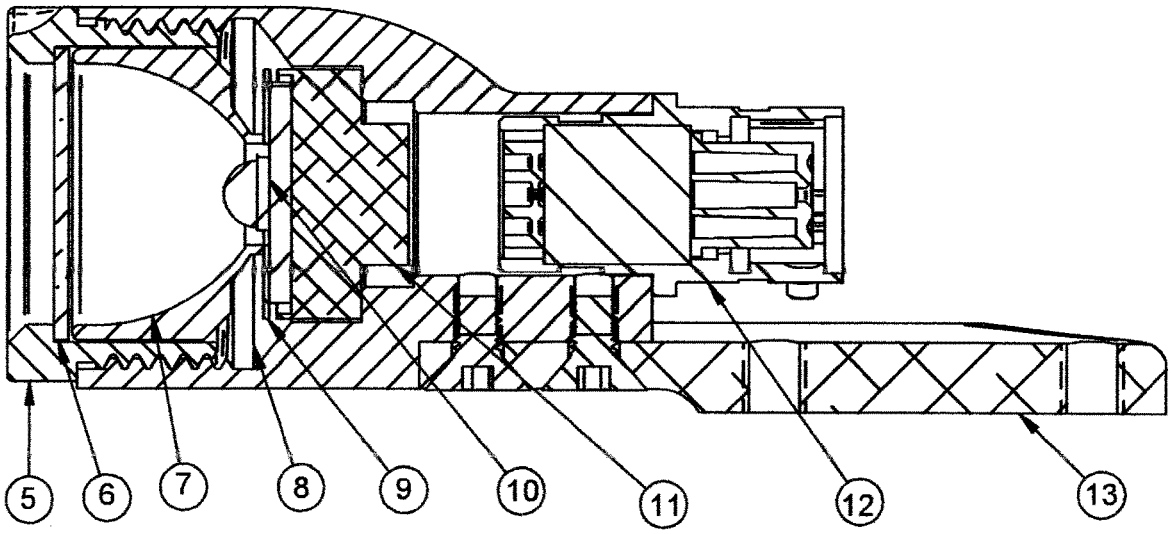
Figure 5:
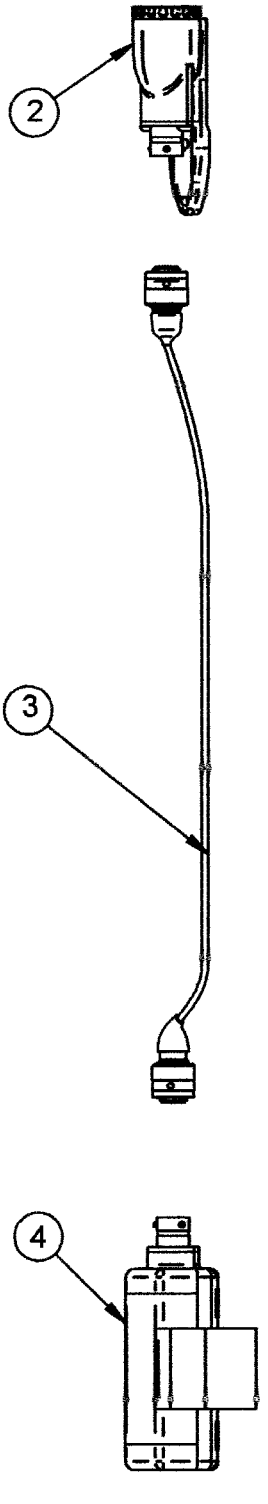
FIG. 5 and FIG. 5*a*: Top views of the major embodiments of the invention FIG. 6; An ISO, exploded view of the components of the Power and Control Unit ("PCU")
Figure 5A:
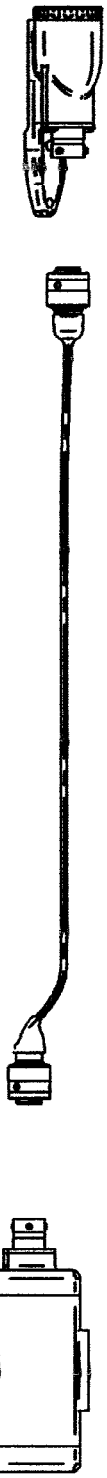

The embodiments of the invention 1 (complete system) shown mounted to a firearm in FIG. 1 and FIG. 1*a*, then FIG. 2 showing the Illumination and Projection Unit (IPU) 2, and the connecting wire harness 3, and the Power and Control Unit (PCU) 4 which comprise the major embodiments of this example (understood to be an example, not a limitation in terms of number of embodiments that make up "the system.") Beginning with the forward (toward muzzle) mounted IPU 2, the exploded view of which is seen in FIG. 3. The IPU consists of a housing 11 of some shape and construction to house the minimally necessary components for illumination and projection. In this example, these components include the threaded lens cap 5, the lens 6, the reflector 7, an insulating washer 8, the LED mounted to a copper plate 9, a heatsink 10. The necessary wiring will connect from the military style connector 12 to the contact points on the LED copper plate. FIG. 3, FIG. 4, FIG. 4*a* show an example of a relatively simply IPU functioning as a flashlight, designed to generate and project a beam of light. It is to be understood that the IPU's may be of any shape and construction to contain the desired components. Other IPU's covered under the claims of this invention may include multiple LED's, or other components, or combination of components that generate/produce/emit/receive electromagnetic radiation (waves) from across the electromagnetic spectrum contained within the same IPU.

The key feature of the IPU 2 is the absence of any power supply. There is no battery or any other provision for power/energy within the IPU 2 itself. Power/Energy must come from an external source. In this case, the wiring harness 3, is connected to the IPU 2 at one end, and to the PCU 4 at the other end, thus supplying the necessary power and control for the LED (an example but not limitation) within the IPU 2 to function.

Figure 6:
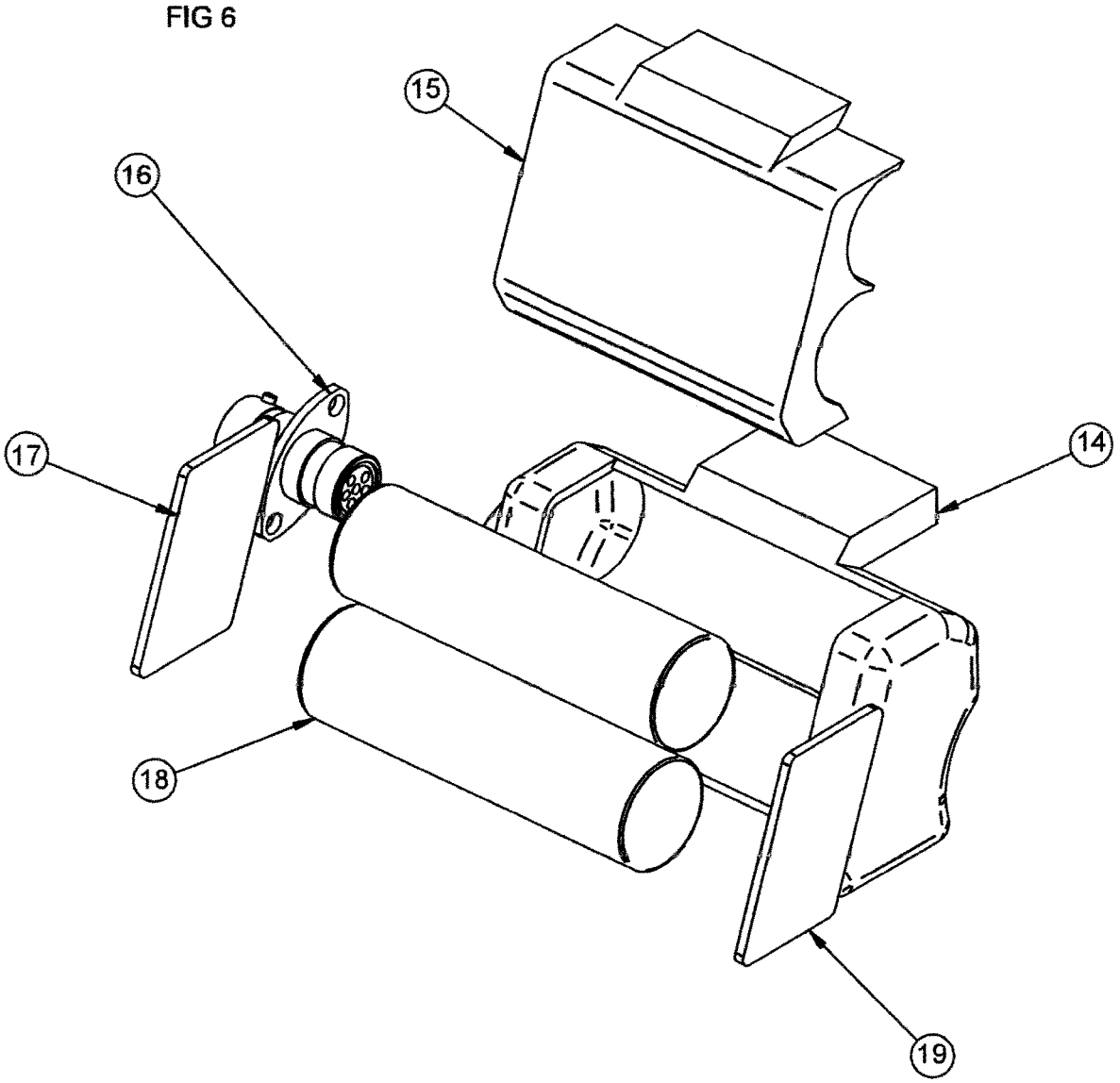

The Power and Control Unit (PCU) FIG. 6, houses the power/energy source and any circuitry, logic and control for the operation of the IPU 2. In this example (understood not to be limited to these components or design or location on the firearm) two batteries 18, the illumination control board 17 contains the necessary circuitry, switches and logic which are desired and necessary to control the IPU 2, in this example the illumination control board would include (among other circuitry and components) the constant current LED driver circuitry. The power management board 19 will handle the battery charging/recharging, control the rate of discharge as well as provide any necessary circuit protection devices. The PCU 4 will send power/energy to the IPU 2 through the wire harness 3. The IPU 2 will be controlled (turned off/on) by controls (pushbutton switches, as an example not a limitation) or software/hardware logic onboard the PCU 4 itself. In addition, a remote switch can be utilized that is not located on the PCU 4 itself. This remote switch, of some shape, type, and size whether momentary or on/off could be physically wired into the wire harness 3 or wirelessly connected to the PCU 4. This remote switch can be removably located anywhere the operator of the firearm desires. As noted earlier in this detailed description that the IPU 2 has the "minimally necessary components for illumination and projection." This is intentional in the design of the invention put forth in this application. In order that the IPU 2 is the lightest and smallest embodiment possible, any components, control circuits, logic, or memory (examples not limitations) that can be moved to the PCU, will be located in the PCU. This invention for example separates out the LED driver circuitry, from the LED mounted to a copper plate, and moves the LED driver circuitry and components to the PCU, allowing the Inventor to create the smallest IPU embodiment possible.

The invention claimed is:

1. A lighting and illumination system for projecting focused electromagnetic radiation of visible wavelengths or invisible wavelengths, removably mountable to a firearm comprising a first housing of some shape, with a bracket or other attachment point, which allows said first housing to be removably mounted to the firearm, said first housing contains a source or sources of electromagnetic radiation and other components to focus, reflect and otherwise direct the electromagnetic radiation in a desired direction and intensity, a second housing of some shape distal to said first housing, with a bracket, or other attachment point, allowing said second housing to be removably mounted to the firearm, said second housing is a source of power, electromotive force, which is supplied to and energizes the source or sources of electromagnetic radiation in said first housing, this power, the electromotive force, is transferred to said first housing through a wiring harness at a proximal end of which is connected to said first housing, and a distal end of which is connected to said second housing, said wiring harness forms a conductive path between the source or sources of electromagnetic radiation in said first housing and the source of power, the electromotive force, in said second housing, said second housing is of some shape internally to hold one or more batteries, or other source of stored or instant power, the electromotive force, and other components necessary for a source to control the source of electromagnetic radiation in said first housing.

2. The lighting and illumination system of claim 1 further comprising said first housing which may hold and utilize more than one source of electromagnetic radiation within the same said first housing.

3. The lighting and illumination system of claim 1 further comprising said first housing which is devoid of any onboard power, said first housing has no source of electromotive force of its own, stored or instant, whether within a structure of said first housing or attached directly to an outer surfaces of said first housing, said first housing must be energized by a separate and distal source of power supplying the electromotive force.

4. The lighting and illumination system of claim 1 further comprising said first housing which may contain more than one reflector of some size, shape, or arrangement necessary to focus, reflect and project the one or more sources of electromagnetic radiation which are contained in said first housing.

5. The lighting and illumination system of claim 1 further comprising the source or sources of electromagnetic radiation mounted in said first housing, these sources of electromagnetic radiation may be any device or component which creates or produces electromagnetic radiation in the form of visible light, or non-visible electromagnetic radiation from any part of the electromagnetic spectrum.

6. The lighting and illumination system of claim 1 further comprising said second housing with a plurality of external control buttons or switches, one of which may act as the on/off control of the source of electromagnetic radiation in said first housing.

7. The lighting and illumination system of claim 1 further comprising said second housing which has a plurality of internal electronic components and circuits for managing the internal source of power, charging and discharging rates, and for controlling the electromotive force supplied to components in said first housing.

8. The lighting and illumination system of claim 1 further comprising a momentary switch removably mounted to the firearm, in a position useful to an operator of the firearm, connected to control circuitry in said second housing by means of a conducting wire harness, or by wireless technology, and serves as additional on/off control of components producing electromagnetic radiation in said first housing.

9. The lighting and illumination system of claim 1 further comprising wireless transmission technology to communicate with a corresponding wireless signal receiving circuitry internal to said second housing.

10. The lighting and illumination system of claim 1 further comprising said second housing may contain wireless signal receiving circuitry allowing wireless communication with a momentary switch.

* * * * *